US011373586B2

(12) United States Patent
Jeong et al.

(10) Patent No.: US 11,373,586 B2
(45) Date of Patent: Jun. 28, 2022

(54) PIXEL CIRCUIT AND DISPLAY PANEL WITH CURRENT CONTROL

(71) Applicant: SAMSUNG DISPLAY CO., LTD., Yongin-si (KR)

(72) Inventors: Minjae Jeong, Yongin-si (KR); Joonho Lee, Seongnam-si (KR); Keechan Park, Seoul (KR); Kyunghoon Chung, Yongin-si (KR); Chongchul Chai, Yongin-si (KR)

(73) Assignees: SAMSUNG DISPLAY CO., LTD., Yongin-si (KR); KONKUK UNIVERSITY INDUSTRIAL COOPERATION CORP, Seoul (KR)

( * ) Notice: Subject to any disclaimer, the term of this patent is extended or adjusted under 35 U.S.C. 154(b) by 0 days.

(21) Appl. No.: 17/078,378

(22) Filed: Oct. 23, 2020

(65) Prior Publication Data

US 2021/0312855 A1 Oct. 7, 2021

(30) Foreign Application Priority Data

Apr. 3, 2020 (KR) ..... 10-2020-0041069

(51) Int. Cl.
*G09G 3/32* (2016.01)

(52) U.S. Cl.
CPC ..... *G09G 3/32* (2013.01); *G09G 2300/0426* (2013.01); *G09G 2300/0439* (2013.01);
(Continued)

(58) Field of Classification Search
CPC ... G09G 3/32–3291; G09G 2300/0421; G09G 2300/0426; G09G 2300/0439;
(Continued)

(56) References Cited

U.S. PATENT DOCUMENTS 7,414,599 B2 8/2008 Chung et al.
10,395,590 B1 8/2019 Lin et al.
(Continued)

FOREIGN PATENT DOCUMENTS

KR 10-0560780 3/2006
KR 10-2019-0051393 5/2019
(Continued)

OTHER PUBLICATIONS

Kim, et al., "PWM Pixel Circuit with LTPS TFTs for Micro-LED Displays", SID 2019 Digest, pp. 192-195.

*Primary Examiner* — Nathan Danielsen
(74) *Attorney, Agent, or Firm* — F. Chau & Associates, LLC

(57) ABSTRACT

A display panel, a pixel circuit, and a display device are disclosed. The display panel includes sub-pixels and a driver driving the sub-pixels. Each sub-pixel includes: an emission element; a first transistor configured to generate a driving current; a constant current control circuit configured to receive a reference voltage and a bias voltage for setting a value of the driving current and including a first capacitor configured to store a first compensation voltage generated by adding a threshold voltage of the first transistor to a difference between the bias voltage and the reference voltage; and a pulse width control circuit configured to receive a data voltage used to determine an emission duration of the emission element and including a second transistor configured to control a pulse width of the driving current according to the data voltage and a second capacitor configured to store a second compensation voltage corresponding to a threshold voltage of the second transistor.

20 Claims, 4 Drawing Sheets

(52) U.S. Cl.
CPC ..... *G09G 2300/0809* (2013.01); *G09G 2310/027* (2013.01); *G09G 2310/0267* (2013.01); *G09G 2310/08* (2013.01); *G09G 2330/028* (2013.01)

(58) Field of Classification Search
CPC ... G09G 2300/0452; G09G 2300/0465; G09G 2300/0809; G09G 2300/0819; G09G 2300/0828–0838; G09G 2300/0842; G09G 2300/0852; G09G 2300/0861; G09G 2300/0866; G09G 2300/0876; G09G 2310/0202; G09G 2310/0205; G09G 2310/0248; G09G 2310/0251; G09G 2310/0267–0275; G09G 2310/0289; G09G 2310/06; G09G 2310/066; G09G 2310/067; G09G 2310/08; G09G 2320/0242; G09G 2320/0271; G09G 2320/0276; G09G 2320/029; G09G 2320/0295; G09G 2320/043–048; G09G 2320/0613–0653; G09G 2320/0666; G09G 2330/028
See application file for complete search history.

(56) References Cited

U.S. PATENT DOCUMENTS

| | | | | |
|---|---|---|---|---|
| 2015/0062193 | A1* | 3/2015 | Kanda | G09G 3/3291 345/690 |
| 2018/0293929 | A1* | 10/2018 | Shigeta | G09G 3/2011 |
| 2019/0318685 | A1 | 10/2019 | Park et al. | |
| 2019/0371231 | A1 | 12/2019 | Kim et al. | |
| 2019/0371232 | A1* | 12/2019 | Kim | G09G 3/32 |
| 2020/0027388 | A1 | 1/2020 | Iwaki et al. | |
| 2021/0174736 | A1* | 6/2021 | Yang | G09G 3/32 |

FOREIGN PATENT DOCUMENTS

| | | |
|---|---|---|
| KR | 10-2019-0119693 | 10/2019 |
| KR | 10-2019-0133695 | 12/2019 |
| KR | 10-2019-0136882 | 12/2019 |

* cited by examiner

PIXEL CIRCUIT AND DISPLAY PANEL WITH CURRENT CONTROL

FIELD

The present disclosure generally relates to displays, and more particularly relates to a pixel circuit and a display panel with time-sharing pixel compensation.

DISCUSSION OF RELATED ART

A light-emitting diode (LED), and in particular, a micro-LED having a size of a micrometer order and using an inorganic material as an emission material, has an emission wavelength that varies with driving current. Thus, it may be more difficult to use a driving method for expressing gradation by using a current than when a display panel includes an organic light-emitting diode.

SUMMARY

An exemplary embodiment of the present disclosure includes a micro-LED, having a size of a micrometer order and using an inorganic material as an emission material, as an emission element in a display panel having a pixel circuit driven via a time-sharing driving method.

An exemplary embodiment includes a pixel circuit for driving a light-emitting diode (LED). An exemplary embodiment includes a display panel including the LED.

Technical implementations of the disclosure are not limited to the exemplary embodiments described, and other technical combinations that are not specifically shown or stated may be clearly understood by one of ordinary skill in the art based on the descriptions herein.

A display panel according to an embodiment includes a plurality of sub-pixels. Each of the plurality of sub-pixels may include an emission element and a pixel circuit. The pixel circuit may include: a first transistor configured to generate a driving current to the emission element; a constant current control circuit configured to receive a reference voltage and a bias voltage for setting a value of the driving current and including a first capacitor configured to store a first compensation voltage, which is generated by adding a threshold voltage of the first transistor to a difference between the bias voltage and the reference voltage; and a pulse width control circuit configured to receive a data voltage used to determine an emission duration of the emission element and including a second transistor configured to control a pulse width of the driving current based on the data voltage and a second capacitor configured to store a second compensation voltage corresponding to a threshold voltage of the second transistor.

A pixel circuit according to an embodiment is connected to at least one of first and second power lines respectively transmitting first and second driving voltages, at least one of first to fourth control lines respectively transmitting first to fourth control signals, a scan line transmitting a scan signal, a data line transmitting a data voltage in synchronization with the scan signal, a bias voltage line transmitting a bias voltage, a reference voltage line transmitting a reference voltage, a sweep voltage line transmitting a sweep voltage monotonically changing in a time period that is set in advance, and an emission element. The pixel circuit may include: a first transistor connected to the first power line and the emission element; a second transistor including a control electrode, a first connection electrode, and a second connection electrode; a second capacitor including a first electrode connected to the control electrode of the second transistor, and a second electrode; a third transistor including a control electrode connected to the scan line, a first connection electrode connected to the data line, and a second connection electrode connected to a control electrode of the second transistor; a fourth transistor including a control electrode connected to the second control line, a first connection electrode connected to a gate of the first transistor, and a second connection electrode connected to the first connection electrode of the second transistor; a fifth transistor including a control electrode connected to the fourth control line, a first connection electrode connected to the second electrode of the second capacitor, and a second connection electrode connected to the second connection electrode of the second transistor; a sixth transistor including a control electrode connected to the third control line, a first connection electrode connected to the sweep voltage line, and a second connection electrode connected to the second electrode of the second capacitor; a seventh transistor including a control electrode connected to the third control line, a first connection electrode connected to the second connection electrode of the second transistor, and a second connection electrode connected to the reference voltage line; and a third capacitor including a first electrode connected to the second connection electrode of the second transistor and a second electrode connected to the second power line.

A display device according to an embodiment includes: a plurality of pixels each including a first transistor, a second transistor connected to a control electrode of the first transistor, and a light-emitting element connected to a connection electrode of the first transistor; and a time-sharing controller generating a reference signal and a bias signal, wherein the reference signal and a signal based on the bias signal are alternately connected to the control electrode of the first transistor, wherein the signal based on the bias signal is responsive to a threshold voltage of the first transistor. The display device may be configured where: the time-sharing controller further generates a monotonically increasing sweep signal; the reference signal and the signal based on the bias signal are alternately connected to a connection electrode of the second transistor; a signal based on the sweep signal is connected to a control electrode of the second transistor.

The above and other embodiments may become more apparent from the following description.

BRIEF DESCRIPTION OF THE DRAWINGS

The above and other embodiments of the disclosure will be more apparent from the following description taken in conjunction with the accompanying drawings, in which.

DETAILED DESCRIPTION

Figure 1:
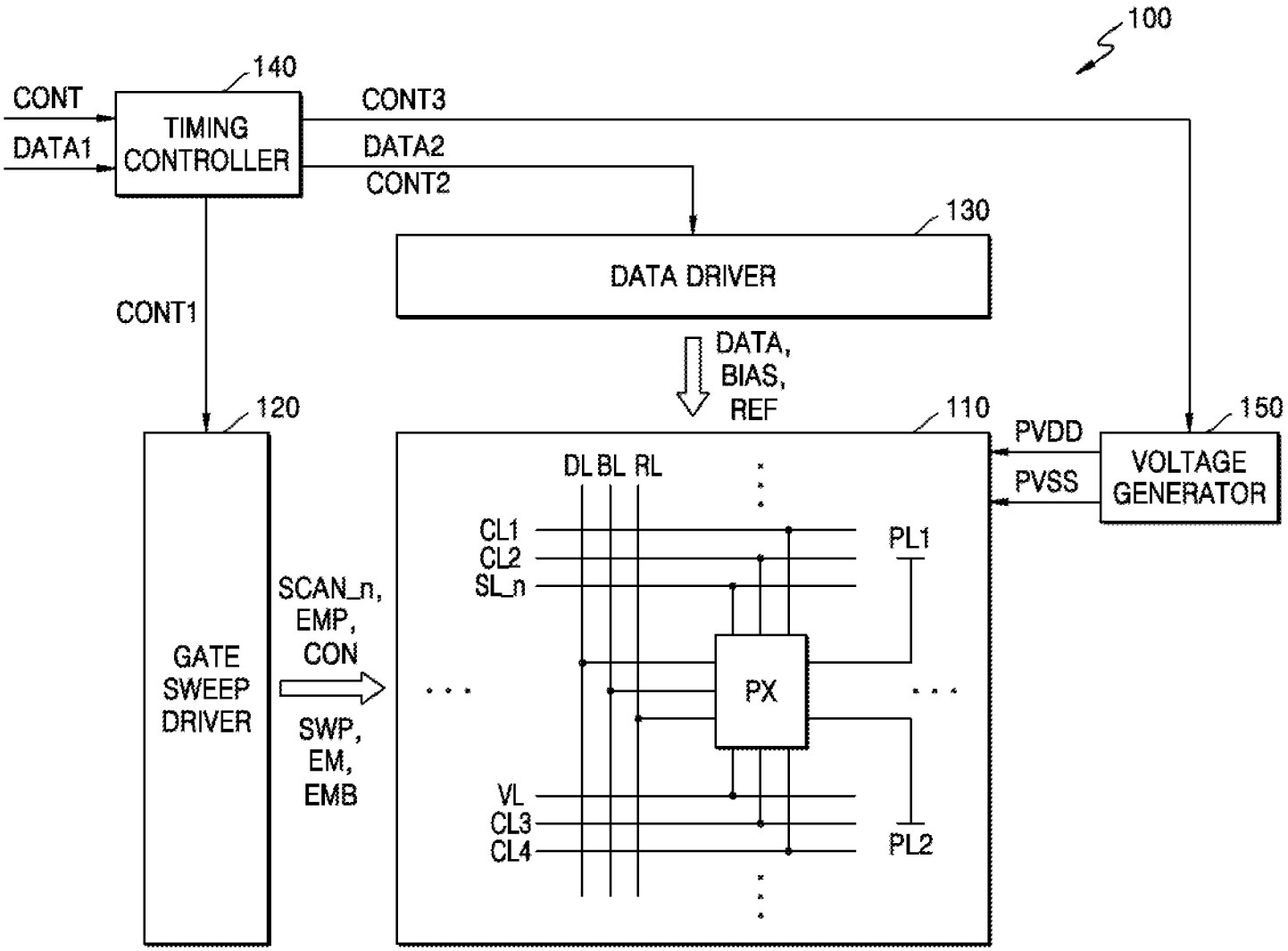
FIG. 1 is a block diagram of a display panel according to an embodiment.

Reference will now be made in detail to embodiments, examples of which are illustrated in the accompanying drawings, wherein like reference numerals may refer to like elements throughout. In this regard, the present embodiments may have different forms and should not be construed as being limited to the descriptions set forth herein. Accordingly, the embodiments are merely exemplary as described below, with reference to the figures, to explain aspects of the present description by means of example, without limitation thereto. As used herein, the term "and/or" includes any and all combinations of one or more of the associated listed items. Throughout the disclosure, the expression "at least one of a, b, or c" may indicate only a, only b, only c, both a and b, both a and c, both b and c, all of a, b, and c, or variations thereof.

As the disclosure allows for various changes and numerous embodiments, particular embodiments will be illustrated in the drawings and described in detail in the written description. The attached drawings for illustrating preferred embodiments of the present disclosure are referred to in order to gain a sufficient understanding of the present disclosure. The disclosure may, however, be embodied in many different forms and should not be construed as being limited to the embodiments set forth herein.

Hereinafter, exemplary embodiments will be described in detail with reference to the attached drawings. For clarity of explanation, description of portions that are irrelevant to the explanation and/or known in the art may be omitted. Like reference numerals in the drawings may denote like elements, and thus duplicate description thereof may be omitted.

It will be understood that although the terms "first," "second," and the like may be used herein to describe various components, that these components should not be limited by these terms. That is, these terms are only used to distinguish one component from another, without limitation to number, order, or the like.

FIG. 1 illustrates a display panel 100 according to an embodiment.

Referring to FIG. 1, a display panel 100 may include a display unit 110, a gate sweep driver 120, a data driver 130, a timing controller 140, and a voltage generator 150. The gate sweep driver 120, the data driver 130, the timing controller 140, and the voltage generator 150 may be collectively referred to as a driver or a driving circuit. In an alternate embodiment, one or more of the gate sweep driver 120, the data driver 130, the timing controller 140, and the voltage generator 150 may be external to the display panel 100.

The display unit 110 may include pixels PX. FIG. 1 illustrates only one pixel PX for convenience, but a plurality of pixels PX may be arranged in the display unit 110. The pixels PX may be arranged in a matrix form including, for example, pixel rows extending in a first direction (e.g., a row direction) and pixel columns extending in a second direction (e.g., a column direction).

Multiple pixels PX may form one unit pixel. The pixel PX of FIG. 1 may correspond to one sub-pixel forming such a unit pixel.

The pixels PX of the display unit 110 may receive an updated data voltage DATA in every frame time period and emit light according to a driving current having a pulse width corresponding to the data voltage DATA and a preset value. Thus, an image corresponding to image data DATA1 of one frame may be displayed.

The pixel PX may be connected to a scan line SL_n, a sweep voltage line VL, and first to fourth control lines CL1 to CL4 that extend, for example, in the row direction, and connected to a bias voltage line BL, a data line DL, and a reference voltage line RL that extend, for example, in the column direction. The pixel PX may be connected to first and second power lines PL1 and PL2.

When the pixels PX are arranged in the display unit 110 in a matrix form, the display unit 110 may include scan lines including the scan line SL_n, sweep voltage lines including the sweep voltage line VL, first to fourth control lines respectively including the first to fourth control lines CL1 to CL4, bias voltage lines including the bias voltage line BL, data lines including the data line DL, reference voltage lines including the reference voltage line RL, and first power lines including the first power line PL1. The display unit 110 may further include second power lines including the second power line PL2.

The scan lines, the sweep voltage lines, and the first to fourth control lines may extend in, for example, the row direction and may be connected to the gate sweep driver 120. The data lines, the bias voltage lines, and the reference voltage lines may extend in, for example, the column direction and may be connected to the data driver 130. The first power lines and the second power lines may be connected to the voltage generator 150. However, this is merely an example, and according to another example, the sweep voltage lines may be connected to the voltage generator 150. According to another example, the sweep voltage lines may extend in the column direction and may be connected to the data driver 130. Also, the bias voltage lines and/or the reference voltage lines may be connected to the voltage generator 150.

Hereinafter, the description will focus on the scan line SL_n, the sweep voltage line VL, the first to fourth control lines CL1 to CL4, the bias voltage line BL, the data line DL, the reference voltage line RL, and the first and second power lines PL1 and PL2 of a pixel PX.

The pixel PX may include an emission element and a pixel circuit outputting a driving current to the emission element. The emission element may emit light in response to the driving current. The pixel circuit includes transistors including first and second transistors and capacitors including first and second capacitors. The pixel circuit may include the first transistor, a constant current control circuit, and a pulse width control circuit. The pixel PX may be described in greater detail with reference to FIGS. 2 and 3.

The gate sweep driver 120 may generate scan signals, a sweep voltage SWP, and first to fourth control signals in response to a first driving control signal CONT1 provided from the timing controller 140. The gate sweep driver 120 may sequentially generate the scan signals. The scan signals, which are sequentially generated, may be provided to the pixels PX through the scan lines. The pixel PX may receive a scan signal SCAN_n through the scan line SL_n.

The gate sweep driver 120 may generate first to fourth control signals EMP, CON, EM, and EMB. The first to fourth control signals EMP, CON, EM, and EMB may be provided to the pixels PX through the first to fourth control lines CL1 to CL4, respectively. The pixel PX may receive the first control signal EMP through the first control line CL1, the second control signal CON through the second control line CL2, the third control signal EM through the third control line CL3, and the fourth control signal EMB through the fourth control line CL4.

The gate sweep driver 120 may generate the sweep voltage SWP that substantially linearly changes in a time period that is set in advance and may provide the generated sweep voltage SWP to the pixels PX through the sweep voltage lines. The sweep voltage SWP may have a value substantially linearly increasing or decreasing during the time period (e.g., an emission duration) that is set in advance. The sweep voltage SWP may be a voltage having a value in time periods (e.g., a threshold voltage storage time period and a data write time period) other than the time period that is set in advance. The pixel PX may receive the sweep voltage SWP through the sweep voltage line VL.

The data driver 130 may receive image data DATA2 provided from the timing controller 140 in a display mode in which the display panel 100 displays an image, and generate the data voltage DATA, a bias voltage BIAS, and a reference voltage REF in response to a second driving control signal CONT2 provided from the timing controller 140.

The data driver 130 generates the data voltage DATA by at least digital-to-analog converting the image data DATA2 in response to the second driving control signal CONT2, and outputs the data voltage DATA to the data line DL. The data driver 130 generates the bias voltage BIAS in response to the second driving control signal CONT2 and outputs the bias voltage BIAS to the bias voltage line BL. The data driver 130 generates the reference voltage REF in response to the second driving control signal CONT2 and outputs the reference voltage REF to the reference voltage line RL.

The data voltage DATA may have a value determined based on a gradation value of the image data DATA2. The bias voltage BIAS and the reference voltage REF may have values that are set by a user or set in advance by a designer of the display panel 100.

The pixel PX may receive the data voltage DATA through the data line DL, the bias voltage BIAS through the bias voltage line BL, and the reference voltage REF through the reference voltage line RL.

The voltage generator 150 generates first and second driving voltages PVDD and PVSS for driving the pixels PX of the display unit 110, in response to a third driving control signal CONT3. The first driving voltage PVDD is applied to the first power line PL1, and the second driving voltage PVSS is applied to the second power line PL2. In an emission region where the emission element emits light, a voltage level of the first driving voltage PVDD may be greater than that of the second driving voltage PVSS.

According to another embodiment, the voltage generator 150 may generate at least one of the sweep voltage SWP, the bias voltage BIAS, and the reference voltage REF.

The timing controller 140 may control the display unit 110 by controlling the gate sweep driver 120, the data driver 130, and the voltage generator 150. The timing controller 140 receives the control signal CONT and the image data DATA1 from an external device. The timing controller 140 may generate the first to third driving control signals CONT1 to CONT3 by using the control signal CONT.

The display panel 100 may display an image by using the pixels PX of the display unit 110. The display panel 100 may display an updated image in every frame time period. One frame time period may sequentially include the threshold voltage storage time period, the data write time period, and the emission duration.

During the threshold voltage storage time period, a first compensation voltage, which is generated by adding a threshold voltage of the first transistor to a difference between the bias voltage BIAS and the reference voltage REF, is stored in the first capacitor, and a threshold voltage of the second transistor is stored in the second capacitor. During the data write time period, the pixel circuit receives a data voltage DATA in synchronization with the scan signal, and a second compensation voltage, which is generated by adding the threshold voltage of the second transistor to a voltage corresponding to the data voltage DATA, may be stored in the second capacitor.

During the emission duration, the first capacitor may be connected between a gate and a source of the first transistor, and thus the emission element may emit light in response to the driving current. Then, a voltage, which is generated by adding the sweep voltage SWP substantially linearly changing and the second compensation voltage, is applied to the gate of the second transistor, and thus, the emission element may stop emitting light after an emission duration corresponding to the pulse width of the driving current.

It is preferable for the first transistors included in the pixels PX to have identical characteristics, but the first transistors may have different characteristics due to a process error, a deterioration condition, and/or the like. When a deviation in the characteristics of the first transistor occurs, a value deviation of the driving current that is output to the emission element might be generated in the pixel circuit of each pixel PX. When the value deviation of the driving current occurs, the emission elements of respective pixels PX may emit light at different brightness, and, particularly for inorganic micro-LEDs, wavelengths of the emitted light might differ. According to the present embodiment, the value deviation of the driving current, which is generated by a deviation in the first transistors, may be compensated for by the pixel circuit, such as by the constant current control circuit, within the pixel PX without reliance upon an external circuit.

It is preferable for the second transistors included in the pixels PX to have identical characteristics, but the second transistors may have different characteristics due to a process error, a deterioration condition, and/or the like. When a deviation in the characteristics of the second transistor occurs, the pulse width of the driving current that is output to the emission element might not be accurately controlled in the pixel circuit of each pixel PX. When the pulse width is not accurately controlled, a gradation expressed by each pixel PX might become inaccurate. According to the present embodiment, a pulse width deviation of the driving current, which is generated due to the deviation in the second transistors, may be compensated for by the pixel circuit, such as by the pulse width control circuit, in the pixel PX without reliance upon an external circuit.

Figure 2:
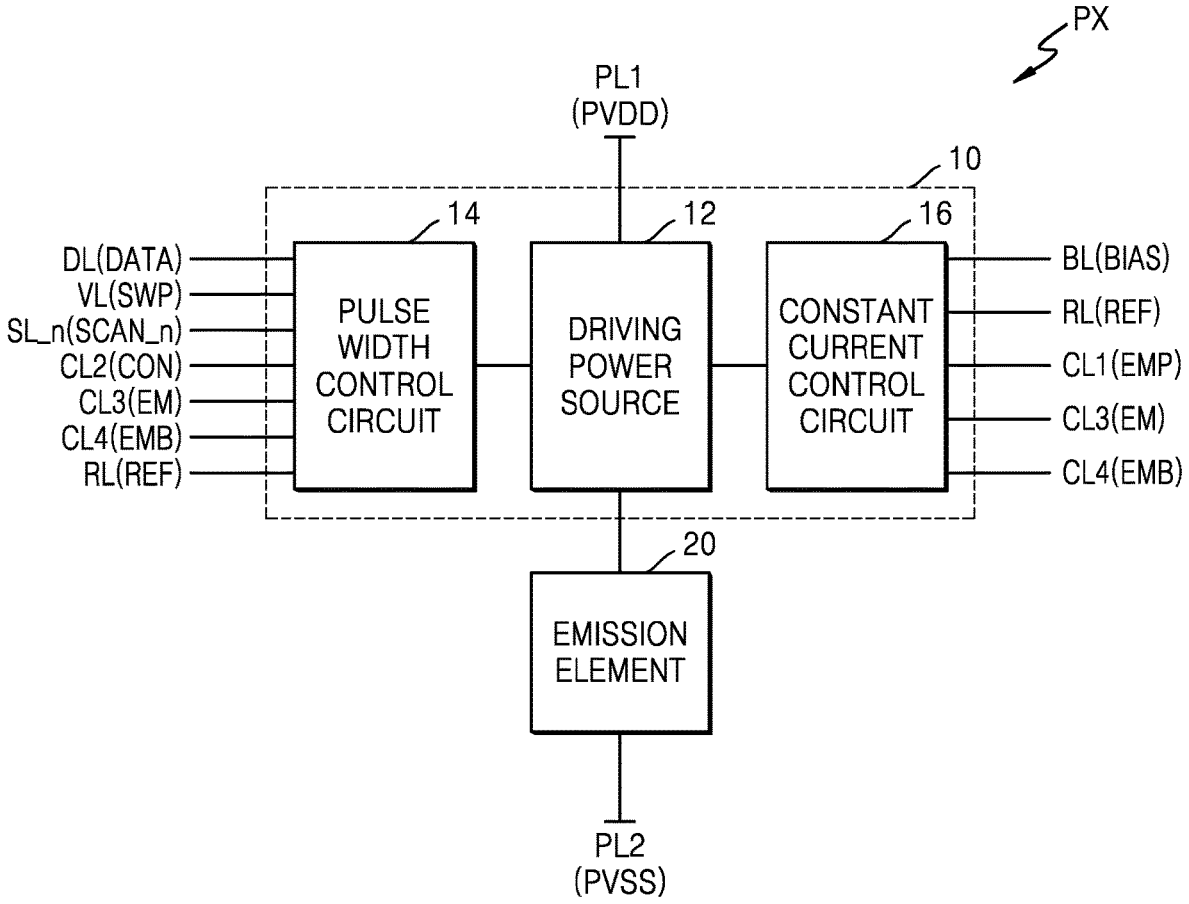
FIG. 2 is a block diagram of a pixel according to an embodiment.

FIG. 2 illustrates a pixel PX according to an embodiment.

Referring to FIG. 2, the pixel PX includes a pixel circuit 10 and an emission element 20. The pixel circuit 10 outputs the driving current to the emission element 20, and the emission element 20 emits light in response to the driving current. The pixel circuit 10 includes a driving power source 12, a pulse width control circuit 14, and a constant current control circuit 16. Although the driving power source 12 and the constant current control circuit 16 are shown separately for ease of description, the driving power source 12 may be incorporated into the constant current control circuit 16, for example, without limitation.

The driving power source 12 includes the first transistor. The first transistor may generate the driving current to be provided to the emission element 20.

The pulse width control circuit 14 may receive the data voltage DATA used to determine an emission duration of the emission element 20. The pulse width control circuit 14 may include the second transistor for controlling the pulse width of the driving current according to the data voltage DATA and the second capacitor for storing therein the second compensation voltage corresponding to the threshold voltage of the second transistor. The second compensation voltage may be a voltage generated by adding the threshold voltage of the second transistor to the voltage corresponding to the data voltage DATA.

The pulse width control circuit 14 may store the second compensation voltage in the second capacitor and may receive the sweep voltage SWP substantially linearly changing during a time period that is set in advance. The pulse width control circuit 14 may apply the voltage, which is generated by adding the second compensation voltage to the sweep voltage SWP, to the gate of the second transistor. As the gate voltage of the second transistor gradually increase due to the sweep voltage SWP, when the voltage generated by adding the sweep voltage SWP and the second compensation voltage is greater than a voltage generated by adding a turn-off voltage and the threshold voltage of the second transistor, the second transistor may be turned on after the emission duration corresponding to the gradation value of the image data DATA2. As the second transistor is turned on, the second transistor transmits a turn-off voltage to a gate of the first transistor, and the first transistor is turned off after the emission duration. Accordingly, the emission element 20 does not emit light after the emission duration and only emits light during the emission duration.

The pulse width control circuit 14 may be connected to the data line DL, the reference voltage line RL, the scan line SL_n, the sweep voltage line VL, and the second to fourth control lines CL2 to CL4. The pulse width control circuit 14 may receive the data voltage DATA through the data line DL and the reference voltage REF through the reference voltage line RL. The pulse width control circuit 14 may receive the scan signal SCAN_n through the scan line SL_n, the sweep voltage SWP through the sweep voltage line VL, and the second to fourth control signals CON, EM, and EMB through the second to fourth control lines CL2 to CL4.

The constant current control circuit 16 may receive the bias voltage BIAS and the reference voltage REF for setting the value of the driving current. The constant current control circuit 16 may include the first capacitor that stores therein the first compensation voltage generated by adding the threshold voltage of the first transistor to a difference between the bias voltage BIAS and the reference voltage REF.

The constant current control circuit 16 may store the first compensation voltage in the first capacitor and connect the first capacitor between the gate and the source of the first transistor. The first transistor controlled by the constant current control circuit 16 may generate the driving current having the value that is set in advance.

The constant current control circuit 16 may be connected to the bias voltage line BL, the reference voltage line RL, and the first, third, and fourth control lines CL1, CL3, and CL4. The constant current control circuit 16 may receive the bias voltage BIAS through the bias voltage line BL and the reference voltage REF through the reference voltage line RL. The constant current control circuit 16 may respectively receive the first, third, and fourth control signals EMP, EM, and EMB through the first, third, and fourth control lines CL1, CL3, and CL4.

The driving current generated by the driving power source 12 flows from the first power line PL1 to the second power line PL2. The driving current flows through the emission element 20, and the emission element 20 emits light at a brightness corresponding to a value of the driving current.

The constant current control circuit 16 may control the driving power source 12 to enable the driving current to have the value, which is set in advance, by compensating for the value deviation of the driving current generated due to a deviation in the threshold voltage of the first transistor. Accordingly, the emission element 20 may emit light having a preset wavelength at a preset brightness.

The pulse width control circuit 14 may control the driving power source 12 to enable the driving current to have the pulse width corresponding to the gradation value of the image data DATA2 by compensating for the deviation in the pulse width of the driving current that is generated due to the deviation in the threshold voltage of the second transistor. Accordingly, the emission element 20 may accurately express a gradation by emitting light during the emission duration corresponding to the gradation value of the image data DATA2.

Figure 3:
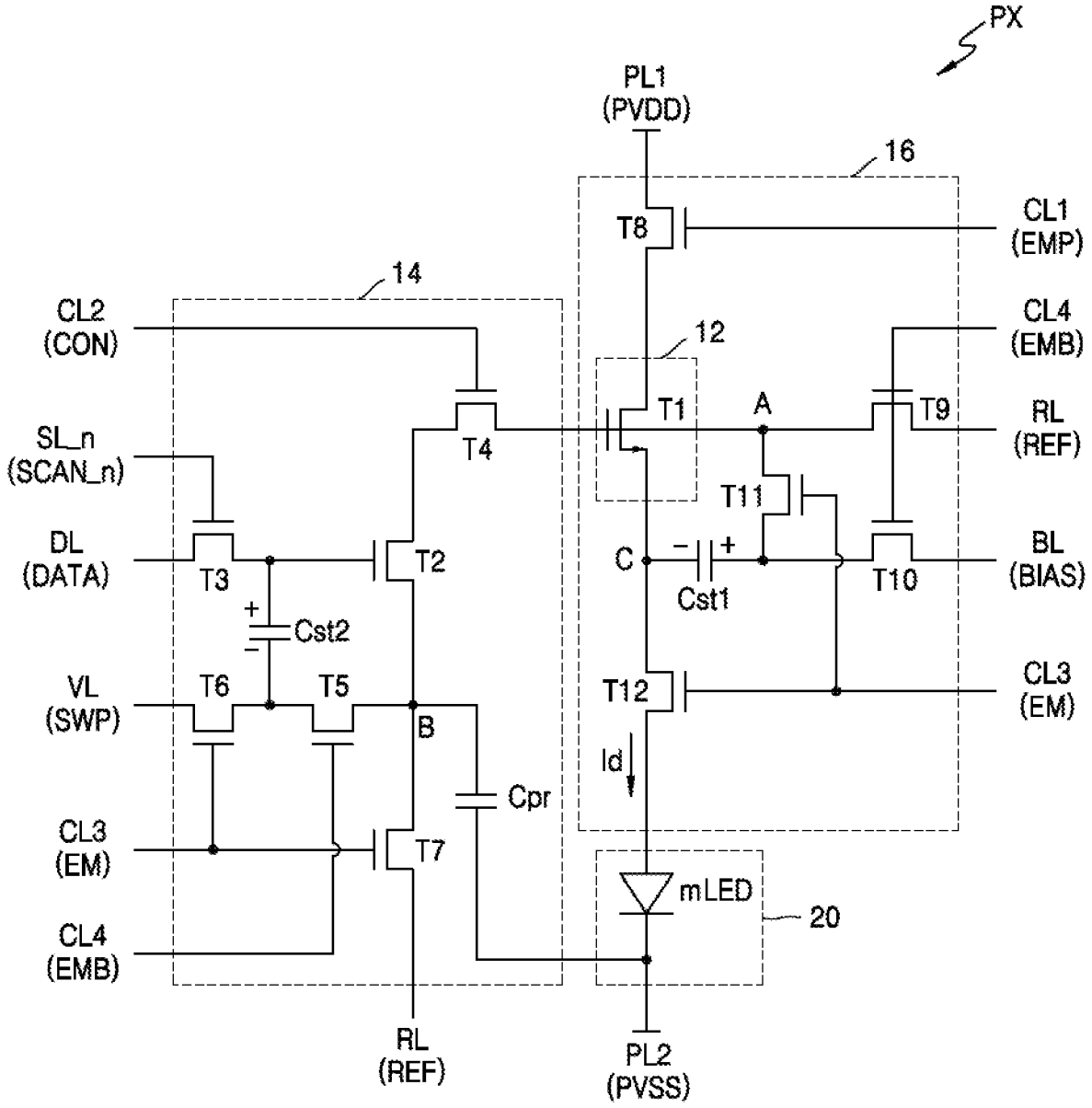
FIG. 3 is a block diagram of a pixel according to an embodiment.

FIG. 3 illustrates an electronic circuit of a pixel PX according to an embodiment.

Referring to FIG. 3, the pixel PX may include an emission element mLED (20) and the pixel circuit (10 of FIG. 2) that outputs the driving current Id to the emission element mLED. The pixel circuit 10 includes the driving power source 12, the pulse width control circuit 14, and the constant current control circuit 16.

The driving power source 12 includes a first transistor T1, the pulse width control circuit 14 includes second to seventh transistors T2 to T7 and second and third capacitors Cst2 and Cpr, and the constant current control circuit 16 includes eighth to twelfth transistors T8 to T12 and a first capacitor Cst1. The circuit diagram of the pixel PX of FIG. 3 is merely an example, and characteristics of each component and/or connections between components may be changed without limitation. Although the first to twelfth transistors T1 to T12 and the first, second, and third capacitors Cst1, Cst2, and Cpr are classified for descriptive purposes here as forming the driving power source 12, the pulse width control circuit 14, and the constant current control circuit 16, such classification may be merely an arbitrary example to facilitate description, without limitation thereto.

For example, FIG. 3 illustrates that the eighth transistor T8 is included in the constant current control circuit 16, but engages with driving of the pulse width control circuit 14 through the third capacitor Cpr. Thus, it may be considered that the eighth transistor T8 is included in the pulse width control circuit 14. Also, the eighth and twelfth transistors T8 and T12 form a current path between the first and second power lines PL1 and PL2 together with the first transistor T1 and thus may be included in the driving power source 12.

The first to twelfth transistors T1 to T12 may be n-type MOSFETs as illustrated in FIG. 3, without limitation thereto. The first to twelfth transistors T1 to T12 may be thin film transistors, without limitation thereto. The first to twelfth transistors T1 to T12 may include semiconductor materials of metal oxide, without limitation thereto. For example, the first to twelfth transistors T1 to T12 may respectively include active layers including metal oxide.

Hereinafter, as illustrated in FIG. 3, the first to twelfth transistors T1 to T12 of the pixel PX are n-type MOSFETs. However, the first to twelfth transistors T1 to T12 may be p-type MOSFETs, and interconnection of the pixel circuit 10 may change accordingly. Exemplary embodiments of the disclosure may be similarly applied to the pixel PX including one or more p-type MOSFETs and the display panel 100 including the pixel PX.

The emission element mLED may be a micro-LED using an inorganic material as an emission material and having a size of a micrometer order, for example, a size less than or equal to about 100 micrometers. The emission element mLED is connected between the source of the first transistor T1 and the second power line PL2. According to an embodiment, as illustrated in FIG. 3, an anode of the emission element mLED may be connected to a second connection electrode of the twelfth transistor T12, and a cathode of the emission element mLED may be connected to the second power line PL2 through which the second driving voltage PVSS is applied. According to another embodiment, the emission element mLED may be connected between the first power line PL1, through which the first driving voltage PVDD is applied, and a drain of the first transistor T1.

The first transistor T1 may include a gate connected to a first node A, a drain connected to the first power line PL1 through which the first driving voltage PVDD is applied, and a source connected to the anode of the emission element mLED. The first transistor T1 outputs the driving current Id, and the value of the driving current Id is determined based on a voltage applied between the gate and the source of the first transistor T1 and on the threshold voltage of the first transistor T1.

The second transistor T2 includes a control electrode, a first connection electrode, and a second connection electrode. The control electrode, the first connection electrode, and the second connection electrode may function as a gate electrode, a drain electrode, and a source electrode and may be referred to as a gate, a drain, and a source, respectively, but are not limited thereto. The second transistor T2 is turned on when a voltage between the control electrode and the second connection electrode is greater than the threshold voltage of the second transistor T2. The second transistor T2 is also turned on when a voltage between the control electrode and the first connection electrode is greater than the threshold voltage of the second transistor T2.

The second capacitor Cst2 includes a first electrode that is connected to the control electrode of the second transistor T2, and a second electrode. The second capacitor Cst2 may store the threshold voltage of the second transistor T2 or the second compensation voltage corresponding to the threshold voltage of the second transistor T2. The second compensation voltage corresponds to the threshold voltage of the second transistor T2. Thus, the second compensation voltage is determined based on the threshold voltage of the second transistor T2. For example, the second compensation voltage corresponding to the threshold voltage of the second transistor T2 may be a voltage generated by adding an arbitrary voltage to the threshold voltage of the second transistor T2. The second compensation voltage increases in proportion to an increase in the threshold voltage of the second transistor T2, and the second compensation voltage decreases in proportion to a decrease in threshold voltage of the second transistor T2.

The third transistor T3 includes a control electrode connected to the scan line SL_n transmitting the scan signal SCAN_n, a first connection electrode connected to the data line DL transmitting the data voltage DATA, and a second connection electrode connected to the control electrode of the second transistor T2. The third transistor T3 may apply the data voltage DATA to the control electrode of the second transistor T2 in response to the scan signal SCAN_n.

The fourth transistor T4 includes a control electrode connected to the second control line CL2 transmitting the second control signal CON, a first connection electrode connected to the gate of the first transistor T1, and a second connection electrode connected to the first connection electrode of the second transistor T2. The fourth transistor T4 may connect the gate of the first transistor T1 and the first connection electrode of the second transistor T2 to each other in response to the second control signal CON.

The fifth transistor T5 includes a control electrode connected to the fourth control line CL4 transmitting the fourth control signal EMB, a first connection electrode connected to the second electrode of the second capacitor Cst2, and a second connection electrode connected to the second connection electrode of the second transistor T2. The fifth transistor T5 may connect the second capacitor Cst2 between the control electrode and the second connection electrode of the second transistor T2 in response to the fourth control signal EMB.

The sixth transistor T6 includes a control electrode connected to the third control line CL3 transmitting the third control signal EM, a first connection electrode connected to the sweep voltage line VL transmitting the sweep voltage SWP, and a second connection electrode connected to the second electrode of the second capacitor Cst2. The sixth transistor T6 applies the sweep voltage SWP to the second electrode of the second capacitor Cst2 in response to the third control signal EM.

The seventh transistor T7 includes a control electrode connected to the third control line CL3 transmitting the third control signal EM, a first connection electrode connected to the second connection electrode of the second transistor T2, and a second connection electrode connected to the reference voltage line RL transmitting the reference voltage REF. The seventh transistor T7 applies the reference voltage REF to the second connection electrode of the second transistor T2 in response to the third control signal EM.

The third capacitor Cpr may include a first electrode connected to the second connection electrode of the second transistor T2 and a second electrode to which a constant voltage is applied during a time period set in advance. The time period, which is set in advance, may at least include from a time point when a voltage corresponding to the data voltage DATA is stored in the second capacitor Cst2, to a time point when the second capacitor Cst2 is separate from the second node B. As illustrated in FIG. 3, the second electrode of the third capacitor Cpr may be connected to the second power line PL2 through which the second driving voltage PVSS is applied. According to another embodiment, the second electrode of the third capacitor Cpr may be connected to one of the bias voltage lines BL, the sweep voltage line VL, the reference voltage line RL, or one of the first to third control lines CL1 to CL3.

The first capacitor Cst1 includes a second electrode connected to the source of the first transistor T1, and a first electrode. The first capacitor Cst1 may store a first compensation voltage corresponding to the threshold voltage of the first transistor T1.

The eighth transistor T8 includes a control electrode connected to the first control line CL1 transmitting the first control signal EMP, a first connection electrode connected to the first power line PL1 transmitting the first driving voltage PVDD, and a second connection electrode connected to the drain of the first transistor T1. The eighth transistor T8 may apply the first driving voltage PVDD to the drain of the first transistor T1 in response to the first control signal EMP.

The ninth transistor T9 includes a control electrode connected to the fourth control line CL4 transmitting the fourth control signal EMB, a first connection electrode connected to the reference voltage line RL transmitting the reference voltage REF, and a second connection electrode connected to the gate of the first transistor T1. The ninth transistor T9 may apply the reference voltage REF to the gate of the first transistor T1 in response to the fourth control signal EMB.

The tenth transistor T10 includes a control electrode connected to the fourth control line CL4 transmitting the fourth control signal EMB, a first connection electrode connected to the bias voltage line BL transmitting the bias voltage BIAS, and a second connection electrode connected to the first electrode of the first capacitor Cst1. The tenth transistor T10 may apply the bias voltage BIAS to the first electrode of the first capacitor Cst1 in response to the fourth control signal EMB.

The eleventh transistor T11 includes a control electrode connected to the third control line CL3 transmitting the third control signal EM, a first connection electrode connected to the first electrode of the first capacitor Cst1, and a second connection electrode connected to the gate of the first transistor T1. The eleventh transistor T11 may connect the first capacitor Cst1 between the gate and the source of the first transistor T1 in response to the third control signal EM.

The twelfth transistor T12 includes a control electrode connected to the third control line CL3 transmitting the third control signal EM, a first connection electrode connected to the source of the first transistor T1, and a second connection electrode connected to the emission element mLED. The twelfth transistor T12 may connect the source of the first transistor T1 and the emission element mLED to each other in response to the third control signal EM and transmit the driving current Id generated in the first transistor T1 to the emission element mLED.

Hereinafter, the driving of the pixel PX will be described with reference to FIG. 4.

Figure 4:
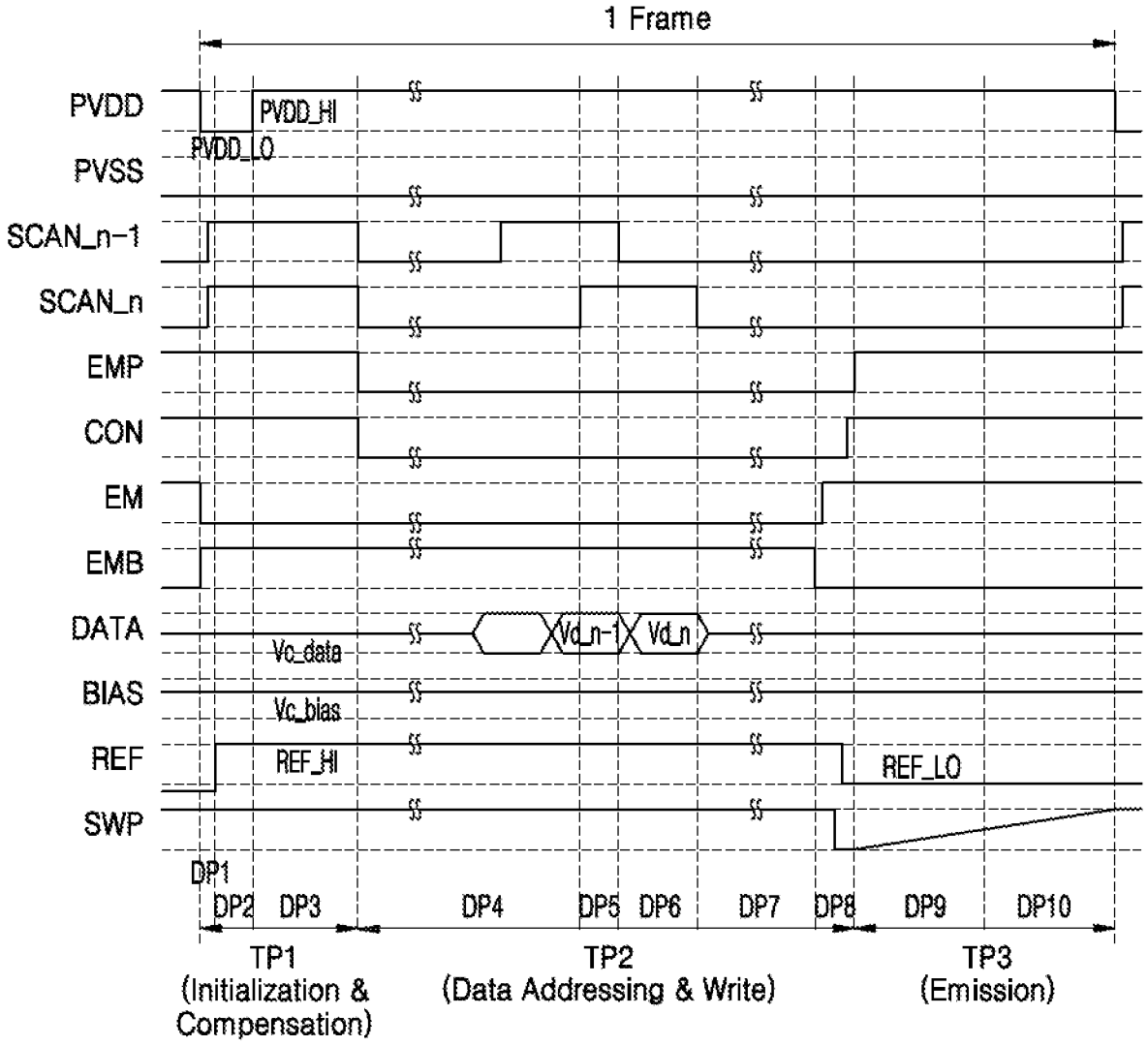
FIG. 4 is a timing diagram of one frame time period when the pixel of FIG. 3 is driven.

FIG. 4 illustrates timing of one frame time period to drive the pixel PX of FIG. 3.

Referring to FIGS. 3 and 4, the pixel PX may receive an updated data voltage DATA in every frame time period when an image is displayed, and may display a gradation corresponding to the received data voltage DATA. One frame 1 Frame may include an initialization and compensation time period TP1 such as for threshold voltage storage, a data addressing and write time period TP2, and an emission time period TP3.

In the initialization and compensation time period TP1, a first compensation voltage, which is generated by adding the threshold voltage of the first transistor T1 to a difference between the bias voltage BIAS and the reference voltage REF, is stored in the first capacitor Cst1, and the threshold voltage of the second transistor T2 is stored in the second capacitor Cst2. Hereinafter, the threshold voltage of the first transistor T1 is referred to as a first threshold voltage Vth1, and the threshold voltage of the second transistor T2 is referred to as a second threshold voltage Vth2.

In the data addressing and write time period TP2, the data voltage DATA is received in synchronization with the scan signal SCAN_n, and a second compensation voltage, which is generated by adding the second threshold voltage Vth2 to a voltage corresponding to the data voltage DATA, is stored in the second capacitor Cst2.

The emission time period TP3 is a time period in which the emission element mLED may emit light. In the emission time period TP3, the first capacitor Cst1 is connected between the gate and the source of the first transistor T1, and the emission element mLED emits light in response to the driving current Id. In the emission time period TP3, the sweep voltage SWP, which may be monotonically and/or substantially linearly increasing, is received. A voltage, which is generated by adding the sweep voltage SWP and the second compensation voltage (e.g., DATA plus Vth2), is applied to the gate of the second transistor T2, and after an emission duration corresponding to the gradation value corresponding to the image data DATA2 of the pixel PX, the emission element mLED stops emitting light.

The initialization and compensation time period TP1 may be divided into first to third time periods DP1 to DP3, the data addressing and write time period TP2 may be divided into fourth to eighth time periods DP4 to DP8, and the emission time period TP3 may be divided into ninth and tenth time periods DP9 and DP10.

The first time period DP1 may be a standby time period, the second time period DP2 may be an initialization time period, the third time period DP3 may be a threshold voltage generation time period, the fourth time period DP4 may be a threshold voltage holding time period, the fifth time period DP5 may be a pre-charge time period, the sixth time period DP6 may be a data write time period, the seventh time period DP7 may be a data holding time period, the eighth time period DP8 may be an emission preparing time period, the ninth time period DP9 may be a sweep time period such as for emission on, and the tenth time period DP10 may be a sweep time period such as for emission off.

The first driving voltage PVDD may be at a low level PVDD_LO (e.g., −4V) in the first and second time periods DP1 and DP2 and at a high level PVDD_HI (e.g., 8V) in the third to tenth time periods DP3 to DP10. The second driving voltage PVSS may be at a low level (e.g., −4V) in the first to tenth time periods DP1 to DP10.

The scan signal SCAN_n may be at a high level in the first to third, fifth and sixth time periods DP1 to DP3, DP5 and DP6, and at a low level in the fourth and seventh to tenth time periods DP4 and DP7 to DP10. A previous scan signal SCAN_n−1 is at a high level in the first to third time periods DP1 to DP3 together with the scan signal SCAN_n. The third transistor T3 is turned on in response to the scan signal SCAN_n at a high level and turned off in response to the scan signal SCAN_n at a low level.

The first control signal EMP is at a high level in the first to third, ninth and tenth time periods DP1 to DP3, DP9 and DP10, and at a low level in the fourth to eighth time periods DP4 to DP8. The eighth transistor T8 is turned on in response to the first control signal EMP at a high level and turned off in response to the first control signal EMP at a low level.

The second control signal CON is at a high level in the first to third, ninth and tenth time periods DP1 to DP3, DP9 and DP10, and at a low level in the fourth to eighth time periods DP4 to DP8. The fourth transistor T4 is turned on in response to the second control signal CON at a high level and turned off in response to the second control signal CON at a low level. In the eighth time period DP8, the second control signal CON may be transitioned to the high level faster or earlier than the first control signal EMP.

The third control signal EM is at a low level in the first to seventh time periods DP1 to DP7 and at a high level in the eighth to tenth time periods DP8 to DP10. The sixth, seventh, eleventh and twelfth transistors T6, T7, T11 and T12 are turned on in response to the third control signal EM at a high level and turned off in response to the third control signal EM at a low level.

Contrary to the third control signal EM, the fourth control signal EMB is at a high level in the first to seventh time periods DP1 to DP7 and at a low level in the eighth to tenth time periods DP8 to DP10. The fifth, ninth and tenth transistors T5, T9 and T10 are turned on in response to the fourth control signal EMB at a high level and turned off in response to the fourth control signal EMB at a low level.

The third control signal EM may be transitioned to the low level first, and then the fourth control signal EMB may be transitioned to the high level in the first time period DP1. Thus, a time period, in which the third and fourth control signals EM and EMB are at the high level, need not exist. After the fourth control signal EMB is transitioned to the low level in the eighth time period DP8, the third control signal EM may be transitioned to the high level.

The data voltage DATA is at a reference level Vc_data (e.g., −1V) in the first to third time periods DP1 to DP3 and at a data level (e.g., −7V to 0V) corresponding to the gradation value of the image data DATA2 in the fourth to sixth time periods DP4 to DP6. The data voltage DATA may be at a data level Vd_n−1 applied to a pixel of a previous row in the fifth time period DP5 and at a data level Vd_n applied to a pixel PX of a current row in the sixth time period DP6. The data voltage DATA may be at the reference level Vc_data in the seventh to tenth time periods DP7 to DP10.

The bias voltage BIAS may remain constant at a reference level Vc_bias (e.g., 7V) in one frame 1 Frame of the first to tenth time periods DP1 to DP10.

The reference voltage REF is at a low level (e.g., −6V) in the first time period DP1, at a high level REF_HI (e.g., 0V) in the second to seventh time periods DP2 to DP7, and at a low level REF_LO (e.g., −5V) in the ninth and tenth time periods DP9 and DP10. The reference voltage REF is transitioned from the high level REF_HI to the low level REF_LO in the eighth time period DP8.

The sweep voltage SWP may be at a high level (e.g., −1V) in the first to seventh time periods DP1 to DP7 and transitioned to the low level (e.g., −6V) in the eighth time period DP8. That is, the sweep voltage SWP may be transitioned from the high level to the low level in the eighth time period DP8, and then the reference voltage REF may be transitioned from the high level REF_HI to the low level REF_LO. The sweep voltage SWP may monotonically or substantially linearly increase from the low level (e.g., −6V) to the high level (e.g., −1V) in the ninth and tenth time periods DP9 and DP10.

In the first time period DP1, the first driving voltage PVDD is transitioned to the low level PVDD_LO (e.g., −4V), and the twelfth transistor T12 is turned off in response to the third control signal EM at the low level. A current does not flow between the first power line PL1 and the second power line PL2, and the emission element mLED does not emit light.

The ninth and tenth transistors T9 and T10 are turned on in response to the fourth control signal EMB at the high level. The reference voltage REF at the low level (e.g., −6V) is applied to the gate of the first transistor T1 through the ninth transistor T9, and the first transistor T1 is turned off. The bias voltage BIAS at the reference level Vc_bias (e.g., 7V) is applied to the first electrode of the first capacitor Cst1 through the tenth transistor T10.

The third transistor T3 is turned on in response to the scan signal SCAN_n at the high level, the fifth transistor T5 is turned on in response to the fourth control signal EMB at the high level, and the fourth transistor T4 is turned on in response to the second control signal CON at the high level.

The reference voltage REF at the low level (e.g., −6V) is applied to the first connection electrode of the second transistor T2 through the fourth transistor T4. Because the data voltage DATA at the reference level Vc_data (e.g., −1V) is applied to the control electrode of the second transistor T2 through the third transistor T3, the second transistor T2 is turned on. The reference voltage REF at the low level (e.g., −6V) is applied to the second node B, and to the second electrode of the second capacitor Cst2 through the fifth transistor T5.

The sixth, seventh, and eleventh transistors T6, T7, and T11 are turned off in response to the third control signal EM at the low level.

In the second time period DP2, the reference voltage REF is transitioned from the low level (e.g., −6V) to the high level REF_HI (e.g., 0V). Because the reference voltage REF at the high level REF_HI (e.g., 0V) is applied to the gate of the first transistor T1 through the ninth transistor T9, the first transistor T1 is turned on.

The first driving voltage PVDD at the low level PVDD_LO (e.g., −4V) is applied to the second electrode of the first capacitor Cst1 through the first transistor T1. The bias voltage BIAS at the reference level Vc_bias (e.g., 7V) is applied to the source of the first transistor T1.

The reference voltage REF at the high level REF_HI (e.g., 0V) is applied to the first connection electrode of the second transistor T2 through the fourth transistor T4. Voltages of the second electrode of the second capacitor Cst2 and the second node B may gradually increase. When the voltage of the second node B increases to a voltage Vc_data−Vth2, which is generated by subtracting the second threshold voltage Vth2 of the second transistor T2 from the data voltage DATA at the reference level Vc_data (e.g., −1V) that is applied to the gate of the second transistor T2, the second transistor T2 is turned off, and the voltages of the second electrode of the second capacitor Cst2 and the second node B no longer increase. The second threshold voltage Vth2 of the second transistor T2 is stored between the first electrode and the second electrode of the second capacitor Cst2.

In the third time period DP3, the first driving voltage PVDD is transitioned from the low level PVDD_LO (e.g., −4V) to the high level PVDD_HI (e.g., 8V). Because the first transistor T1 is turned on, voltages of a second electrode and a third node C of the first capacitor Cst1 gradually increase. When the voltage of the third node C increase to a voltage REF_HI−Vth1, which is generated by subtracting the first threshold voltage Vth1 of the first transistor T1 from the reference voltage REF at the high level REF_HI (e.g., 0V) that is applied to the gate of the first transistor T1, the first transistor T1 is turned off, and the voltages of the second electrode and the third node C of the first capacitor Cst1 no longer increase. A first compensation voltage Vc_bias−REF_HI+Vth1, which is generated by subtracting the voltage REF_HI−Vth1 from the bias voltage BIAS at the reference level Vc_bias (e.g., 7V), is stored between the first and second electrodes of the first capacitor Cst1.

In the fourth time period DP4, the scan signal SCAN_n, the first control signal EMP, and the second control signal CON are transitioned to the low level. Accordingly, the third, eighth, and fourth transistors T3, T8, and T4 are turned off. The first compensation voltage Vc_bias−REF_HI+Vth1 is stored in the first capacitor Cst1, and the second threshold voltage Vth2 of the second transistor T2 keeps being stored in the second capacitor Cst2. The data voltage DATA at the data level (e.g., −7V to 0V) corresponding to the gradation value of the image data DATA2 is applied to the data line DL.

The previous scan signal SCAN_n−1 is transitioned to the high level before the fifth time period DP5. In the fifth time period DP5, the scan signal SCAN_n is transitioned to the high level, and the third transistor T3 is turned on. The data voltage DATA has the data level Vd_n−1 (e.g., −7V to 0V) applied to the pixel of the previous row.

The data voltage DATA at the data level Vd_n−1 (e.g., −7V to 0V) is applied to the gate of the second transistor T2 and the first electrode of the second capacitor Cst2 through the third transistor T3. Because an electric potential of the first electrode of the second capacitor Cst2 changes, an electric potential of the second node B also changes due to charge sharing between the second capacitor Cst2 and the third capacitor Cpr. The second transistor T2 may be turned on or off according to the data level Vd_n−1 (e.g., −7V to 0V) of the data voltage DATA.

In the sixth time period DP6, the pervious scan signal SCAN_n−1 is transitioned to the low level, and a data voltage DATA at the data level Vd_n (e.g., −7V to 0V) is applied to the data line DL.

The data voltage DATA at the data level Vd_n (e.g., −7V to 0V) is applied to the gate of the second transistor T2 and the first electrode of the second capacitor Cst2 through the third transistor T3. Because the electric potential of the first electrode of the second capacitor Cst2 changes from the data voltage DATA at the reference level Vc_data (e.g., −1V) to the data voltage DATA at the data level Vd_n (e.g., −7V to 0V), the electric potential of the second node B also changes due to the charge sharing between the second capacitor Cst2 and the third capacitor Cpr.

The electric potential of the second node B has been Vc_data−Vth2 until the fourth time period DP4. The electric potential of the second node B changes to Vc_data−Vth2+Cst2/(Cst2+Cpr)*(Vd_n−Vc_data) due to the charge sharing. Accordingly, a second compensation voltage Vth2+Cpr/(Cst2+Cpr)*(Vd_n−Vc_data), which is generated by subtracting Vc_data−Vth2+Cst2/(Cst2+Cpr)*(Vd_n−Vc_data) from the data voltage DATA at the data level Vd_n (e.g., −7V to 0V) is stored between the first electrode and the second electrode of the second capacitor Cst2. The second compensation voltage Vth2+Cpr/(Cst2+Cpr)*(Vd_n−Vc_data) stored in the second capacitor Cst2 will be simply referred to as a second compensation voltage Vth2+Vcst2. Vcst2 indicates Cpr/(Cst2+Cpr)*(Vd_n−Vc_data).

The second transistor T2 may be turned on or off according to the data level Vd_n (e.g., −7V to 0V) of the data voltage DATA. When the data level Vd_n is higher than the reference level Vc_data, the second transistor T2 is turned on, and when the data level Vd_n is lower than the reference level Vc_data, the second transistor T2 is turned off.

In the seventh time period DP7, the scan signal SCAN_n is transitioned to the low level, and the third transistor T3 is turned off. The data voltage at the reference level Vc_data (e.g., −1V) may be applied to the data line DL.

The first compensation voltage Vc_bias−REF_HI+Vth1 is stored in the first capacitor Cst1, and the second compensation voltage Vth2+Vcst2 is stored in the second capacitor Cst2.

In the eighth time period DP8, the fourth control signal EMB is transitioned to the low level, and thus, the fifth, ninth, and tenth transistors T5, T9, and T10 are turned off. As the fifth transistor T5 is turned off, the second electrode of the second capacitor Cst2 is insulated from the second node B. As the ninth transistor T9 is turned off, the reference voltage REF is not applied to the gate of the first transistor T1. As the tenth transistor T10 is turned off, the bias voltage BIAS is not applied to the first electrode of the first capacitor Cst1.

The third control signal EM is transitioned to the high level, and the sixth, seventh, eleventh, and twelfth transistors T6, T7, T11, and T12 are turned on. As the sixth transistor T6 is turned on, the second electrode of the second capacitor Cst2 is connected to the sweep voltage line VL. As the seventh transistor T7 is turned on, the reference voltage REF is applied to the second node B.

As the eleventh transistor T11 is turned on, the first capacitor Cst1 is connected between the gate and the source of the first transistor T1. Because the first compensation voltage Vc_bias−REF_HI+Vth1, which is stored in the first capacitor Cst1, is applied between the gate and the source of the first transistor T1, the first transistor T1 may generate the driving current Id that is related to the voltage Vc_bias−REF_HI. As the twelfth transistor T12 is turned on, the first transistor T1 is connected to the emission element mLED.

Then, the sweep voltage SWP is transitioned from the high level (e.g., −1V) to the low level (e.g., −6V). Because the electric potential of the second electrode of the second capacitor Cst2 is decreased by as much as a difference (e.g., 5V) between the high level (e.g., −1V) and the low level (e.g., −6V) of the sweep voltage SWP, the electric potential of the first electrode of the second capacitor Cst2 is also decreased by as much as a difference (e.g., 5V) between the high level (e.g., −1V) and the low level (e.g., −6V) of the sweep voltage SWP.

Then, the reference voltage REF is transitioned from the high level REF_HI (e.g., 0V) to the low level REF_LO (e.g., −5V). The reference voltage REF at the low level REF_LO (e.g., −5V) is applied to the second connection electrode of the second transistor T2 through the seventh transistor T7.

When the gradation value corresponding to the image data DATA2 corresponding to the pixel PX is 0, the pixel PX may receive a data voltage DATA at a highest data level Vd_n (e.g., 0V) in the sixth time period DP6. In this case, Vth2+Cpr/(Cst2+Cpr)*1 is stored in the second capacitor Cst2. Because the electric potential of the second electrode of the second capacitor Cst2 is decreased by as much as the difference (e.g., 5V) due to the transition of the sweep voltage SWP, an electric potential of the gate of the second transistor T2 becomes (Vth2+Cpr/(Cst2+Cpr)*1)−5V. Because the reference voltage REF at the low level REF_LO (e.g., −5V) is applied to the second connection electrode of the second transistor T2, the second transistor T2 is turned on, and the reference voltage REF at the low level REF_LO (e.g., −5V) is applied to the gate of the first transistor T1. Because a voltage higher than the second driving voltage PVSS is applied to the source of the first transistor T1, the first transistor T1 is turned off. That is, when the gradation value of the image data DATA2 corresponding to the pixel PX is 0, the first transistor T1 is turned off before the ninth time period DP9, and thus, the emission element mLED does not emit light.

Then, the second control signal CON is transitioned to the high level, and the fourth transistor T4 is turned on. As described above, when the gradation value of the image data DATA2 corresponding to the pixel PX is 0, the second transistor T2 is turned on, and the reference voltage REF at the low level REF_LO (e.g., −5V) is applied to the gate of the first transistor T1 through the second transistor T2 and the fourth transistor T4.

In the ninth time period DP9, the first control signal EMP is transitioned to the high level, and thus, the eighth transistor T8 is turned on. Accordingly, a current path is formed between the first power line PL1 and the second power line PL2. Because the first driving voltage PVDD at the high level PVDD_HI (e.g., 8V) is applied to the drain of the first transistor T1, the first transistor T1 generates the driving current Id related to the voltage Vc_bias−REF_HI. The driving current Id has a value proportional to $(Vc_bias-REF_HI)^2$. That is, the driving current Id has a value that is independent of a value of the first threshold voltage Vth1 of the first transistor T1.

The emission element mLED emits light at a brightness corresponding to the driving current Id. The driving current Id is determined according to the difference between the bias voltage BIAS at the reference level Vc_bias (e.g., 7V) and the reference voltage REF at the high level REF_HI (e.g., 0V) and is not related to the value of the first threshold voltage Vth1 of the first transistor T1, and thus, the emission element mLED emits light at a predefined brightness without being affected by a deviation in the threshold voltage of the first transistor T1.

When the gradation value of the image data DATA2 corresponding to the pixel PX is 0, the reference voltage REF at the low level REF_LO (e.g., −5V) is applied to the gate of the first transistor T1, and the first transistor T1 is turned off. Thus, the driving current Id is not generated, and the emission element mLED does not emit light.

The sweep voltage SWP substantially linearly increases at the low level (e.g., −6V). Because the second compensation voltage Vth2+Vcst2 is stored in the second capacitor Cst2, the voltage of the gate of the second transistor T2 becomes Vth2+Vcst2+SWP and substantially linearly increases identically to the sweep voltage SWP. A difference between the voltage of the gate of the second transistor T2 and the reference voltage REF at the low level REF_LO (e.g., −5V), that is, Vth2+Vcst2+SWP−REF_LO, gradually increases as well. When the voltage between the gate and source of the second transistor T2 becomes identical to the second threshold voltage Vth2 of the second transistor T2, that is, when Vcst2+SWP−REF_LO becomes 0, the second transistor T2 is turned on, and the reference voltage REF at the low level REF_LO (e.g., −5V) is applied to the gate of the first transistor T1. As the first transistor T1 is turned off, the driving current Id is not generated, and the emission element mLED stops emitting light.

It is assumed that the sweep voltage SWP substantially linearly increases from a low level (SWP_LO) (e.g., −6V) at a gradient (a), for example, a*t+SWP_LO, according to time (t). A point in time (t1), when Vcst2+SWP−REF_LO becomes 0, is (REF_LO−Vcst2−SWP_LO)/a. Because Vcst2 is equal to Cpr/(Cst2+Cpr)*(Vd_n−Vc_data), the point in time (t1), when the second transistor T2 is turned on, is determined according to the data level Vd_n and the reference level Vc_data of the data voltage DATA and is not related to the value of the second threshold voltage Vth2 of the second transistor T2. Therefore, the point in time (t1), when the second transistor T2 is turned on, the first transistor T1 is turned off due to the reference voltage at the low level REF_LO (e.g., −5V), and the emission element mLED stops emitting light, may be determined according to the data voltage DATA and is not affected by the deviation in the second threshold voltage Vth2 of the second transistor T2, thereby being accurately controlled by the data voltage DATA.

The ninth time period DP9 and the tenth time period DP10 are distinguished from each other according to the point in time (t1) when the emission element mLED stops emitting light.

Although the light emission of the emission element mLED stops in the tenth time period DP10, the sweep voltage SWP keeps monotonically or substantially linearly increasing. Although the voltage of the gate of the second transistor T2 keeps increasing, the second transistor T2 is already on, and the emission element mLED does not emit light. Therefore, no change occurs in the pixel PX.

While the second transistor T2 is turned on, the reference voltage REF at the low level REF_LO (e.g., −5V) is applied to the first electrode of the second capacitor Cst2 between the ninth and tenth time periods DP9 and DP10.

As described, the pixel PX is driven during one frame 1 Frame. Because the emission element mLED of the pixel PX emits light having a certain brightness, which is not affected by the deviation of the first threshold voltage Vth1 and which is determined by the bias voltage BIAS and the reference voltage REF only during an emission duration that is not affected by the deviation of the second threshold voltage Vth2, and is determined by the data voltage DATA, colors and gradations may be accurately expressed.

According to an exemplary embodiment, a pixel circuit, which is driven in a time-sharing manner, may be provided to drive an emission element such as a micro-LED. As the pixel circuit internally compensates for threshold voltages of transistors, a pulse width and a value of a driving current that the pixel circuit outputs to an emission element may be accurately controlled. The emission element may emit light having a certain brightness and color. Therefore, display quality of the display panel may be optimized.

According to an exemplary embodiment, a display device includes pixels each including a first transistor, a second transistor connected to a control electrode of the first transistor, and a light-emitting element connected to a connection electrode of the first transistor. The display device may also include a time-sharing controller generating a reference signal and a bias signal. The reference signal, and a signal based on the bias signal, are alternately connected to the control electrode of the first transistor. The signal based on the bias signal is responsive to a threshold voltage of the first transistor. The time-sharing controller may further generate a monotonically increasing sweep signal. The reference signal and the signal based on the bias signal may be alternately connected to a connection electrode of the second transistor. A signal based on the sweep signal may be connected to a control electrode of the second transistor.

It shall be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the pertinent art that various changes in form and details may be made therein without departing from the spirit and scope of the present disclosure as defined by the claims.

What is claimed is:

1. A display panel comprising:

a plurality of sub-pixels each comprising an emission element and a pixel circuit, wherein the pixel circuit comprises:

a first transistor configured to generate a driving current to the emission element;

a constant current control circuit configured to receive a reference voltage and a bias voltage for setting a value of the driving current and comprising a first capacitor configured to store a first compensation voltage, which is generated by adding a threshold voltage of the first transistor to a difference between the bias voltage and the reference voltage; and a pulse width control circuit configured to receive a data voltage used to determine an emission duration of the emission element and comprising a second transistor configured to control a pulse width of the driving current according to the data voltage and a second capacitor configured to store a second compensation voltage corresponding to a threshold voltage of the second transistor.

2. The display panel of claim 1, wherein:

a value deviation of the driving current caused by a deviation of the first transistor included in each of the plurality of sub-pixels is internally compensated for by the constant current control circuit of the pixel circuit included in each of the plurality of sub-pixels, and a pulse width deviation of the driving current caused by a deviation of the second transistor included in each of the plurality of sub-pixels is internally compensated for by the pulse width control circuit of the pixel circuit included in each of the plurality of sub-pixels.

3. The display panel of claim 1, wherein the constant current control circuit is further configured to store the first compensation voltage in the first capacitor and connect the first capacitor between a gate and a source of the first transistor, and the first transistor is configured to generate the driving current having a set value.

4. The display panel of claim 1, wherein the pulse width control circuit is configured to:

store, in the second capacitor, the second compensation voltage, which is generated by adding the threshold voltage of the second transistor to a voltage corresponding to the data voltage;

receive a sweep voltage monotonically changing during a time period that is set in advance; and control the emission duration of the emission element by applying a voltage, generated by adding the second compensation voltage to the sweep voltage, to a gate of the second transistor.

5. The display panel of claim 1, wherein a value of the driving current is determined based on a difference between the bias voltage and the reference voltage and is not related to a value of the threshold voltage of the first transistor.

6. The display panel of claim 1, wherein:

a pulse width of the driving current is determined by the data voltage and is not related to a value of the threshold voltage of the second transistor.

7. The display panel of claim 1, further comprising:

first and second power lines respectively transmitting first and second driving voltages to the pixel circuit;

a scan line transmitting a scan signal to the pixel circuit;

a data line transmitting the data voltage to the pixel circuit in synchronization with the scan signal;

a bias voltage line transmitting the bias voltage to the pixel circuit;

a reference voltage line transmitting the reference voltage to the pixel circuit;

a sweep voltage line transmitting, to the pixel circuit, a sweep voltage linearly changing during a time period that is set in advance; and first to fourth control lines respectively transmitting first to fourth control signals to the pixel circuit.

8. The display panel of claim 7, further comprising a driver for driving the plurality of sub-pixels, wherein the driver is configured to respectively output the first and second driving voltages to the first and second power lines, output the scan signal to the scan line, output the data voltage to the data line in synchronization with the scan signal, output the bias voltage to the bias voltage line, output the reference voltage to the reference voltage line, output the sweep voltage to the sweep voltage line, and respectively output the first to fourth control signals to the first to fourth control lines.

9. The display panel of claim 7, wherein the first transistor and the emission element are connected in series between the first power line and the second power line.

10. The display panel of claim 7, wherein the pulse width control circuit comprises:

the second transistor comprising a control electrode, a first connection electrode, and a second connection electrode;

the second capacitor comprising a first electrode connected to the control electrode of the second transistor, and a second electrode;

a third transistor comprising a control electrode connected to the scan line, a first connection electrode connected to the data line, and a second connection electrode connected to the control electrode of the second transistor;

a fourth transistor comprising a control electrode connected to the second control line, a first connection electrode connected to a gate of the first transistor, and a second connection electrode connected to the first connection electrode of the second transistor;

a fifth transistor comprising a control electrode connected to the fourth control line, a first connection electrode connected to the second electrode of the second capacitor, and a second connection electrode connected to the second connection electrode of the second transistor;

a sixth transistor comprising a control electrode connected to the third control line, a first connection electrode connected to the sweep voltage line, and a second connection electrode connected to the second electrode of the second capacitor;

a seventh transistor comprising a control electrode connected to the third control line, a first connection electrode connected to the second connection electrode of the second transistor, and a second connection electrode connected to the reference voltage line; and a third capacitor comprising a first electrode connected to the second connection electrode of the second transistor and a second electrode to which a constant voltage is applied during a time period that is set in advance.

11. The display panel of claim 10, wherein the second electrode of the third capacitor is connected to the second power line.

12. The display panel of claim 7, wherein the constant current control circuit comprises:

the first capacitor comprising a first electrode and a second electrode connected to a source of the first transistor;

an eighth transistor comprising a control electrode connected to the first control line, a first connection electrode connected to the first power line, and a second connection electrode connected to a drain of the first transistor;

a ninth transistor comprising a control electrode connected to the fourth control line, a first connection electrode connected to the reference voltage line, and a second connection electrode connected to a gate of the first transistor;

a tenth transistor comprising a control electrode connected to the fourth control line, a first connection electrode connected to the bias voltage line, and a second connection electrode connected to the first electrode of the first capacitor;

an eleventh transistor comprising a control electrode connected to the third control line, a first connection electrode connected to the first electrode of the first capacitor, and a second connection electrode connected to the gate of the first transistor; and a twelfth transistor comprising a control electrode connected to the third control line, a first connection electrode connected to the source of the first transistor, and a second connection electrode connected to the emission element.

13. The display panel of claim 1, further comprising a driver for driving the plurality of sub-pixels, wherein the driver is configured to drive the plurality of sub-pixels to display an image in every frame time period, wherein the frame time period comprises:

a threshold voltage storage time period in which the first compensation voltage is stored in the first capacitor and the threshold voltage of the second transistor is stored in the second capacitor;

a data write time period when the data voltage is received in synchronization with a scan signal and the second compensation voltage is stored in the second capacitor; and an emission time period in which the emission element starts emitting light in response to the driving current by connecting the first capacitor between a gate and a source of the first transistor and when the emission element stops emitting light after the emission duration corresponding to the pulse width by applying, to a gate of the second transistor, a voltage generated by adding the second compensation voltage and a sweep voltage substantially linearly changing.

14. The display panel of claim 13, wherein:

the first capacitor is separated from the gate of the first transistor during the threshold voltage storage time period and the data write time period, and is connected between the gate and the source of the first transistor during the emission time period, and the second capacitor is connected between the gate and a source of the second transistor during the threshold voltage storage time period and the data write time period and is separated from the source of the second transistor during the emission time period.

15. The display panel of claim 13, wherein, during the emission time period, when the voltage generated by adding the sweep voltage and the second compensation voltage is greater than a voltage generated by adding a turn-off voltage and the threshold voltage of the second transistor, the second transistor is turned on and the first transistor is turned off after the emission time period by applying the turn-off voltage to the gate of the first transistor.

16. The display panel of claim 1, wherein the emission element comprises a micro light-emitting diode having a size less than or equal to 100 micrometers and using an inorganic material as an emission material.

17. A pixel circuit connected to at least one of first and second power lines respectively transmitting first and second driving voltages, at least one of first to fourth control lines respectively transmitting first to fourth control signals, a scan line transmitting a scan signal, a data line transmitting a data voltage in synchronization with the scan signal, a bias voltage line transmitting a bias voltage, a reference voltage line transmitting a reference voltage, a sweep voltage line transmitting a sweep voltage monotonically changing in a time period that is set in advance, and an emission element, the pixel circuit comprising:

a first transistor connected to the first power line and the emission element;

a second transistor comprising a control electrode, a first connection electrode, and a second connection electrode;

a second capacitor comprising a first electrode connected to the control electrode of the second transistor, and a second electrode;

a third transistor comprising a control electrode connected to the scan line, a first connection electrode connected to the data line, and a second connection electrode connected to the control electrode of the second transistor;

a fourth transistor comprising a control electrode connected to the second control line, a first connection electrode connected to a gate of the first transistor, and a second connection electrode connected to the first connection electrode of the second transistor;

a fifth transistor comprising a control electrode connected to the fourth control line, a first connection electrode connected to the second electrode of the second capacitor, and a second connection electrode connected to the second connection electrode of the second transistor;

a sixth transistor comprising a control electrode connected to the third control line, a first connection electrode connected to the sweep voltage line, and a second connection electrode connected to the second electrode of the second capacitor;

a seventh transistor comprising a control electrode connected to the third control line, a first connection electrode connected to the second connection electrode of the second transistor, and a second connection electrode connected to the reference voltage line; and a third capacitor comprising a first electrode connected to the second connection electrode of the second transistor and a second electrode connected to the second power line.

18. The pixel circuit of claim 17, further comprising:

a first capacitor comprising a first electrode and a second electrode connected to a source of the first transistor;

an eighth transistor comprising a control electrode connected to the first control line, a first connection electrode connected to the first power line, and a second connection electrode connected to a drain of the first transistor;

a ninth transistor comprising a control electrode connected to the fourth control line, a first connection electrode connected to the reference voltage line, and a second connection electrode connected to the gate of the first transistor;

a tenth transistor comprising a control electrode connected to the fourth control line, a first connection electrode connected to the bias voltage line, and a second connection electrode connected to the first electrode of the first capacitor;

an eleventh transistor comprising a control electrode connected to the third control line, a first connection electrode connected to the first electrode of the first capacitor, and a second connection electrode connected to the gate of the first transistor; and a twelfth transistor comprising a control electrode connected to the third control line, a first connection electrode connected to the source of the first transistor, and a second connection electrode connected to the emission element.

19. A display device comprising:

a plurality of pixels each including a first transistor, a second transistor connected to a control electrode of the first transistor, and a light-emitting element connected to a connection electrode of the first transistor; and a time-sharing controller generating a reference signal and a bias signal, wherein the reference signal and a signal based on the bias signal are alternately connected to the control electrode of the first transistor, wherein the signal based on the bias signal is responsive to a threshold voltage of the first transistor, wherein the time-sharing controller further generates a monotonically increasing sweep signal, wherein a signal based on the sweep signal is connected to a control electrode of the second transistor.

20. The display device of claim 19, wherein:

the reference signal and the signal based on the bias signal are alternately connected to a connection electrode of the second transistor.

* * * * *